United States Patent [19]

Henning

[11] 4,219,911

[45] Sep. 2, 1980

[54] APPARATUS FOR EXPANDING THE WIDTH OF PREFORMED FIBROUS WEBS

[75] Inventor: John C. Henning, Cincinnati, Ohio

[73] Assignee: The Stearns & Foster Company, Cincinnati, Ohio

[21] Appl. No.: 908,399

[22] Filed: May 22, 1978

Related U.S. Application Data

[62] Division of Ser. No. 665,618, Mar. 10, 1976, Pat. No. 4,106,166.

[51] Int. Cl.[2] ..... D04H 1/70

[52] U.S. Cl. ..... 28/103; 19/161.1

[58] Field of Search ..... 19/106 R, 157, 161.1, 19/243; 26/82, 87; 28/103; 162/204, 205, 270, 271, 289, 306, 361; 226/197

[56] References Cited

U.S. PATENT DOCUMENTS

| | | | |
|---|---|---|---|
| 382,916 | 5/1888 | Walker et al. | 19/161.1 |
| 390,923 | 10/1888 | Walker et al. | 19/161.1 |
| 1,560,670 | 11/1925 | De Vries | 162/271 UX |
| 2,305,997 | 12/1942 | Shields | 26/82 X |
| 3,105,283 | 10/1963 | Pernick | 26/82 X |
| 3,105,997 | 10/1963 | Mackie | 19/243 |
| 3,369,276 | 2/1968 | Kalwaites | 28/103 X |
| 3,432,890 | 3/1969 | Burnham et al. | 19/243 X |
| 3,461,508 | 8/1969 | Cole | 28/282 |
| 3,651,543 | 3/1972 | Loo et al. | 19/161.1 |
| 3,808,639 | 5/1974 | Tautraisas | 19/161.1 |
| 3,953,909 | 5/1976 | Yazawa et al. | 28/282 |

*Primary Examiner*—Robert Mackey

*Attorney, Agent, or Firm*—Wood, Herron & Evans

[57] ABSTRACT

This invention is directed to apparatus for expanding the width of preformed fibrous webs. Fibrous webs having fibers oriented in their lengthwise direction can be widened by this apparatus and this orientation is still maintained in the widened web. The apparatus functions by feeding the web to a blade edge lying at an angle to the lengthwise direction, abruptly changing the direction of travel of the web at the edge from the lengthwise direction to a second direction, and turning the web fibers in the second direction while expanding the width of the web. The profile of fibrous webs, i.e., the thickness, uniformity, weight and fiber density, across its width can be changed and controlled according to the apparatus disclosed.

10 Claims, 6 Drawing Figures

APPARATUS FOR EXPANDING THE WIDTH OF PREFORMED FIBROUS WEBS

This is a division of application Ser. No. 665,618 filed Mar. 10, 1976, now U.S. Pat. No. 4,106,166 granted Aug. 15, 1978.

BACKGROUND OF THE INVENTION

This invention relates to a method and apparatus for expanding the width of a preformed fibrous web; and, more lengthwise fiber orientation and/or controlling the web profile.

Nonwoven webs of fibrous materials and nonwoven fabrics are commercially important materials in the textile and related industries. Nonwoven webs are formed from textile fibers or so-called "staple" fibers, such as cotton, wool, wood, jute, viscose rayon, nylon, polyester, or other materials varying in length from about ¼ inch to about 2 or more inches. Such fibers are processed through conventional textile machinery. For example, a carding machine may be used to form a continuous length of rather two-dimensional, loosely associated fibers known as a carded web. These webs may be assembled to form a multiple layer or three-dimensional fibrous web of significant weight, e.g., from about several hundred grains to thousands of grains per square yard.

In continuous nonwoven fibrous webs, the textile fibers are arrayed at various angles to the lengthwise axis of the web. Depending upon processing techniques, the fibrous webs may be oriented, that is parallelized, or isotropic. When a web is formed by the action of a carding machine, the fibers are usually predominantly oriented in the machine direction, i.e., the lengthwise axis of the fibrous web, which is the direction in which a web is formed and is moved continuously and assembled with other webs of similar fiber orientation. On the other hand, isotropic webs may be formed such as by air-laying.

Carding or air-laying machines produce somewhat standardized fibrous web widths and it becomes necessary usually at some stage in processing to vary these widths either simply to obtain a particular width or for the purpose of efficiency, among other purposes. Many apparatuses and methods are known to the art for expanding the width of a nonwoven fibrous web including the use of bowed rollers, springs, cross-stretching belts, diverging disks, and the like. All of these apparatuses and methods have disadvantages including among other things the need for complicated and expensive equipment, the inability to expand the width of the web without either altering the orientation of the fibers or weakening the web, and the inability to control and change the profile of web, i.e., the thickness, uniformity, and weight of the web across its width.

SUMMARY OF THE INVENTION

This invention consists of a unique method and apparatus for expanding the width of preformed fibrous webs. The invention overcomes a number of problems heretofore associated with the prior art techniques mentioned above. In accordance with the principles of the invention, a continuous length of a preformed fibrous web is bent over the edge of a blade lying at an angle to the direction of web travel whereby both the direction of web travel and web fibers are abruptly changed to expand the web width. Furthermore, according to this method, original webs having a predominant fiber orientation can be maintained in such orientation during expansion. In another of its features, this invention provides a method and means to control and change the profile of preformed fibrous webs in a simple manner without web rupture and without the need for rather expensive or complicated equipment.

In its general aspect, this invention provides a method which permits a fibrous web comprising multiple layers to be spread to varying widths. The steps of the process inlude moving the continuous length of web on a conveyor in its lengthwise direction toward a blade having at least a portion of its edge lying at an angle to the direction of movement of the web where expanding of the web width is accomplished. Since expanding occurs only at one area of travel, there is no need to hold the web down during travel. Complicated devices such as belts, suction boxes, nip rollers, and the like employed in the prior art are thus eliminated. The freely traveling web is abruptly turned at the blade edge thereby abruptly changing its direction of travel from the lengthwise direction to a second direction. The abrupt change in direction at the blade edge turns the web fibers into the second direction while expanding the width of the web. The expanded web is then taken off the edge in the second direction. The take-off of the web from the blade is at a speed greater than or at least equal to the velocity of the web prior to entering the angulated blade area.

This invention is thus in contrast to prior art methods of the type disclosed in U.S. Pat. Nos. 2,594,591; 2,618,012; 2,758,048; 2,952,893; 3,303,547 and 3,708,831 which involve methods and apparatus for spreading webs by such aforementioned, complicated means. Furthermore, while it has also been known to doff fibers from a cylinder at an angle thereto to change fiber orientation in the manufacture of a loose web as disclosed in U.S. Pat. No. 3,066,359, the present invention is directed to preformed fibrous webs of three-dimensional form. Also, the latter mentioned patent does not involve abruptly changing directions and simultaneously turning fibers during expansion, let alone by simplified means employed herein. Also, according to this invention, webs having a predominant fiber orientation can be expanded and because, abruptly at the turning blade, the fibers are turned in the new direction, the expanded web has the same predominant fiber orientation as the original web. The method of this invention therefore permits expanding the width of a continuous length of preformed fibrous web without altering the predominant fiber orientation of the web while eliminating complicated machinery and web hold down devices.

In a preferred form of the invention, the web comprising multiple layers is bent over the edge of a blade lying at an angle to the conveyor carrying the web and the direction of web travel is abruptly changed to a second direction generally perpendicular to the plane of the conveyor and the plane of original web travel. That is, for example, if the unexpanded web were travelling on a horizontal conveyor in the lengthwise direction, the direction of web travel is abruptly changed at the blade edge to generally a vertical plane. The web fibers are thereby locked at the blade edge and turned over the edge to the new direction of web travel. The fibers which are parallel or at a zero angle of orientation with respect to the free edges of the original web are turned and maintained in the predominant orientation when turned over the edge of the blade and in the new direction. Those fibers which are at an angle to the free edges of the original web are, depending upon the blade angle, either maintained or oriented to a greater degree in the new direction.

A further object of this invention is to provide a method and apparatus which permits the control of the profile of the web material being handled on the web machinery, i.e., the thickness, uniformity, weight and fiber density of the web across its width. In a preferred form of this aspect of the invention, a blade is employed having an edge comprising multiple angles whereby portions of the edge lie at different angles with respect to the direction of travel of the original web. Proper selection of the angles of the blade edge permits control of the profile of the web material being expanded. The method includes the steps of moving the preformed fibrous web on a conveyor in the lengthwise direction, feeding the web to the blade edge, and abruptly changing the direction of travel of the web at the edge with the web bending over the multiple angulated edge portions of the blade. The angle of the fibers and web travel changes to a direction generally perpendicular to the conveyor. The web is taken-off the edge at a speed greater than or at least equal to the velocity of the web prior to entering the angulated blade area. The degree of expansion of the web across its width varies in conformity with the angulated portions of the blade edge. This invention thus permits a web profile to be altered to a desired, controlled profile. Prior art methods do not provide for such profile control of a preformed fibrous web by so expanding a portion or distinct portions of the web across its width.

This invention further admits of the use of a plurality of consecutively arranged expanding areas whereby a preformed fibrous web may be sequentially expanded in a continuous web forming operation.

These and other advantages of this invention will be further appreciated by reference to the following detailed description and accompanying drawings.

DETAILED DESCRIPTION OF THE INVENTION

Figure 1:
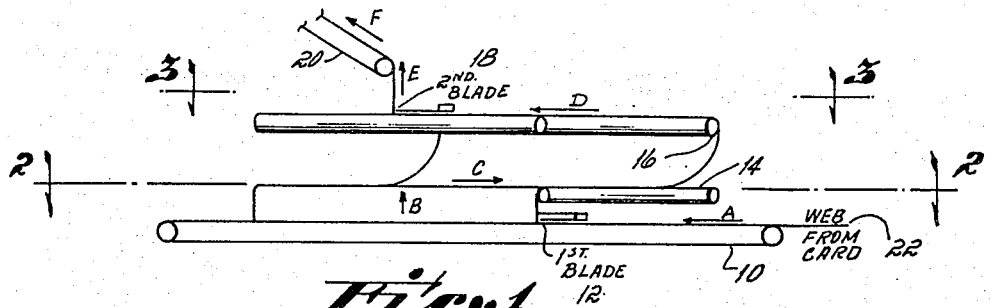
FIG. 1 is a schematic elevational view illustrating an apparatus in accordance with the principles of the method of this invention for expanding the width of a continuous length of preformed fibrous web.

Referring to FIG. 1, the apparatus includes a first conveyor 10, a first blade having an edge 12, a second conveyor 14, a third conveyor 16, a second blade having an edge 18, and a take-off conveyor 20.

A continuous length of preformed fibrous web 22 is carried on the moving surface of the conveyor 10 toward the first blade in a direction A. The source of supply of the web is not critical. For example, the web may come from a supply roll or from an adjacent upstream web-forming operation, e.g., conventional carding or air-laying, in a continuous web forming and expanding operation. The web may be formed of multiple two-dimensional layers assembled together. Where conventional carding operations are employed, the predominant fiber orientation resulting from the web forming operation is in the machine direction A.

Figure 2:
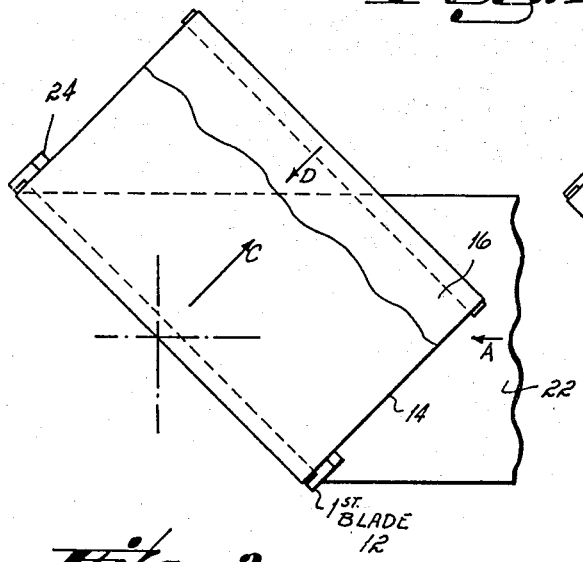
FIG. 2 is a view taken along line 2—2 of FIG. 1.

Along the first conveyor 10 is disposed the first blade which is formed of suitable material such as sheet metal to have a flat surface which rides against web 22 as it is carried on the conveyor 10 and which terminates in a free edge 12. The blade is so disposed that the edge 12 lies at an angle to the direction A of web movement. This angle is predetermined and is calculated by the degree of width expansion desired. As shown in FIG. 2, edge 12 there illustrated lies at a 45° angle with respect to the moving web direction A. The blade is held in a stationary position at the end 24 opposite the free edge by means not shown.

At the blade edge 12 the traveling web 22 is abruptly turned from its lengthwise direction of travel, A, to a new direction B which lies on a plane perpendicular to the plane of the web moving in direction A. Although exact perpendicularity is not required, it is generally desirable because of the necessity to lock the web fibers at the blade edge and turn them into the new direction B to maintain the predominant lengthwise fiber orientation in the expanded web.

The width of the web 22 is expanded along the edge 12 to a width equaling about the length of the edge 12. The direction of web travel changes from direction A to B. However, the predominant fiber orientation is maintained. The fibers which are parallel or at a zero angle of orientation with respect to the free edges of the original web are turned and maintained in the predominant orientation when turned over the edge of the blade and in the new direction of web travel, B.

The web is taken off the edge 12 by the second conveyor 14 at a speed greater than or at least equal to the speed of the web on conveyor 10. If the original web is at its desired expanded width after passing over the blade edge 12 the expanded web can continue in the direction B directly to and onto the take-off conveyor 20 to be rolled or transferred to a downstream processing step. The conveyors 14 and 16 are employed when it is desired to further expand the web width. In this case, the web 22 is fed to a second blade on vertically spaced conveyors 14 and 16 so oriented with respect to the conveyor 10 that the directions of web travel C and D respectively are perpendicular to blade edge 12.

Figure 3:
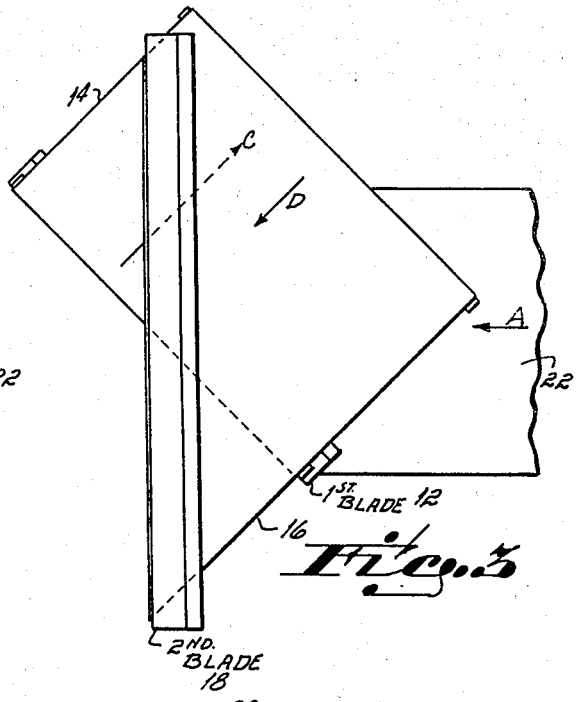
FIG. 3 is a view taken along line 3—3 of FIG. 1.

Referring to FIG. 3, the second blade is identical in construction to the first blade and terminates in the free edge 18. The blade is so disposed that edge 18 lies at an angle to the movement of the web 22 on the conveyor 16 in the direction D. In FIG. 3, this angle is illustrated as 45°. At the second blade edge 18, as described in relation to the first blade, the traveling web is abruptly turned from its direction of travel, D, to a new direction E which lies in a plane perpendicular to the plane of the web moving in direction D. In practice, the web will move in generally horizontal planes in directions A, C and D and in vertical planes in directions B and E.

The width of the once-expanded web is again expanded along the edge 18 to a width equaling about the length of edge 18. Again the direction of web travel changes abruptly from direction D to E, and the fibers are turned over the blade edge to maintain the lengthwise fiber orientation.

The web 22 is taken off the edge 18 by the take-off conveyor 20. Conveyor 20 so disposed that the direction of web travel F on the conveyor is perpendicular to the blade edge 18. Conveyor 20 is vertically displaced from conveyor 10 but is in line therewith such that the expanded web can exit the expanding apparatus on the same line on which it entered allowing for convenient arrangement of the apparatus in a continuous web forming and expanding line.

Figure 4:
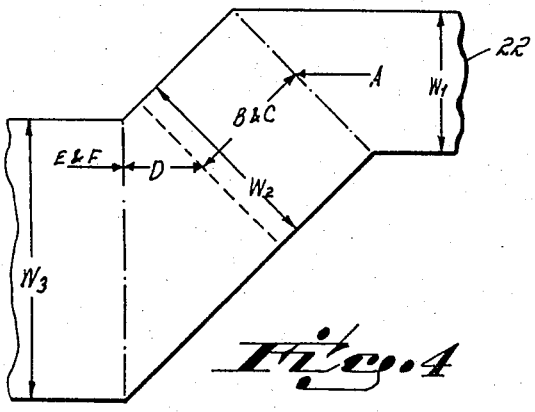
FIG. 4 is a developed view of the web illustrated in FIG. 1.

Referring now to FIG. 4, the amount of expansion of the web is a function of the angle at which the blade edge lies to the direction of travel of the web at the edge. The increase in width of the original web from $W_1$ to $W_2$ at blade edge 12 is calculated as follows: $W_2$ equals $W_1$ divided by the cosine of the angle of the blade to the direction of travel, A. In FIGS. 1 and 2, the blade has been illustrated as lying at a 45° angle to the direction of travel of the web, A. Accordingly, if $W_1$ were 45 inches, $W_2$ would equal 63.63. Likewise in FIGS. 1 and 3, blade edge 18 has been illustrated as lying at an angle of 45° to the direction of web movement D. Thus, width $W_2$ of 63.63 inches is expanded at edge 18 to a width $W_3$ equaling 89.97 inches. In the apparatus illustrated in FIG. 1, the blades may conveniently be mounted so that they can be rotated to change the angle at which they lie with respect to the conveyors to accomplish different amounts of web expansion, as desired.

Figure 5:
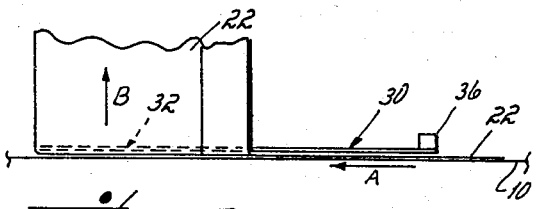
FIG. 5 is a schematic elevational view of a blade used in one embodiment of this invention.
Figure 6:
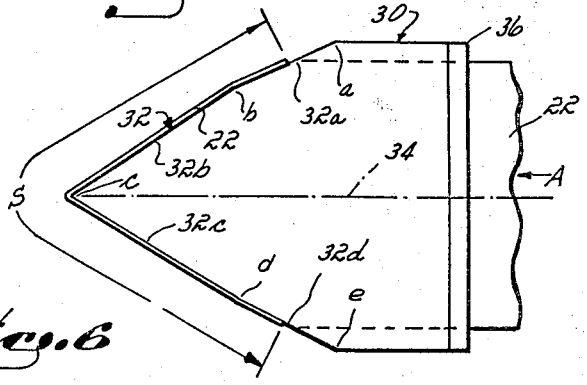
FIG. 6 is a top view of FIG. 5.

Referring now to FIGS. 5 and 6, there is shown a blade 30 for expanding the width of a continuous length of preformed fibrous web 22 in accordance with the principles of the method of this invention and, simultaneously, altering the profile of the web. The blade 30 is in the shape of a V which includes an edge 32 formed of four portions: 32*a* extending between points a and b; 32*b*, extending between points b and c; 32*c*, extending between points c and d; and 32*d*, extending between points d and e. Portions 32*a* and 32*b* and 32*c* and 32*d* are symmetrical about the centerline 34 of the web 22.

The blade 30 is held stationary in the web expanding operation by securing the end 36 such that the flat surface of the blade rises on the web 22 moving in the direction A on the conveyor 10, and edge 32 presents a free edge about which the web is turned. Edge portions 32*a* and 32*d* lie at an angle to the direction A of web travel, and edge portions 32*b* and 32*c* lie at a greater angle to the direction of travel. Thus the degree of expansion of the web will be greater over portions 32*b* and 32*c* than over 32*a* and 32*d*. This results in an alteration of thickness, weight, and fiber density across the web in its widthwise direction to produce either a non-uniform cross-section or uniform cross-section depending upon the result desired and the profile of the original web. By proper selection of the angles of orientation of the blade edge portions, the web can be expanded in any number of distinct directions to give a desired, controlled distribution of fibers across the width of the web. The V-shaped blade shown in FIGS. 5 and 6 is merely illustrative, and blades of other symmetric or asymmetric shapes may be employed to give a desired web profile.

The method is identical to that described in relation to FIG. 1. The preformed fibrous web 22 having a predominant lengthwise fiber orientation is moved on the conveyor 10 in the lengthwise direction A toward the blade 30. The web 22 is unrestrained on the conveyor 10. At the blade edge 32 the direction of travel of the web is abruptly changed to a new direction B which lies in a plane perpendicular to the plane of the web moving in direction A. The web bends over the multiple angulated blade edge portions, and the web fibers are locked and turned into direction B. The web is expanded more at edge portions 32*b* and 32*c* than at 32*a* and 32*d*, and the total expanded width, S, is the sum of these individual expansions. Where the original web fibers are generally parallelly oriented, the predominant fiber orientation is maintained. The web is taken off edge 30 by either conveyor 20, or conveyor 14, if the now profiled web is to be fed to a second blade. The speed of take off is greater than or at least equal to the speed of the web on conveyor 10.

Having described this invention and its presently contemplated best modes, it will become apparent to those of ordinary skill that obvious variations may be made in view of the above description to obtain the benefits thereof.

What I claim is:

1. Apparatus for expanding the width of a continuous length of a preformed fibrous web of staple fibers comprising at least one blade having an edge for locking web fibers and controlling the uniformity of fiber orientation throughout the width of web expansion, means for moving said web in a lengthwise direction at an angle to at least a portion of said edge, and means for abruptly changing the direction of travel of said web at said edge from said lengthwise direction to a second direction and turning the web fibers in said second direction while web fibers are locked at said edge to expand said width with controlled uniformity of fiber orientation.

2. The apparatus of claim 1 wherein said edge has a plurality of portions lying at differing angles to said lengthwise direction, each said edge portion locking web fibers and controlling the uniformity of fiber orientation throughout the width of web expansion across each said edge portion.

3. The apparatus of claim 1 comprising a plurality of said blades whose edges lie at differing angles to said lengthwise direction.

4. The apparatus of claim 1 wherein said blade edge comprises a generally V-shaped edge portion, each side of said V-shaped edge portion locking web fibers and controlling the uniformity of fiber orientation throughout the width of web expansion across each said edge portion.

5. The apparatus of claim 4 wherein said V-shaped blade edge includes a first pair of edge portions intersection at one end on the longitudinal axis of said web moving in said lengthwise direction and being symmetrical thereabout and a second pair of edge portions at the respective opposite ends of said first pair lying at a smaller angle than said first to said lengthwise direction, said edge portions obtaining a desired profile in the expanded web, each said edge portion locking web fibers and controlling the uniformity of fiber orientation throughout the width of web expansion across each said edge portion.

6. The apparatus of claim 1 wherein said means for moving said web is a conveyor for carrying the web.

7. The apparatus of claim 6 wherein said means for abruptly changing and turning the web fibers is a second conveyor for carrying the web.

8. The apparatus of claim 7 wherein said conveyor is in a horizontal plane and said second conveyor is in a vertical plane.

9. The apparatus of claim 1 wherein said blade edge includes a plurality of edge portions lying at different angles to said lengthwise direction, said edge portions controlling thickness, weight and fiber density across the width of the web, each said edge portion locking web fibers and controlling the uniformity of fiber orientation throughout the width of web expansion across each said edge portion.

10. Apparatus for expanding the width of a continuous length of a preformed fibrous web of staple fibers comprising at least one blade having an edge for locking web fibers and controlling the uniformity of fiber orientation throughout the width of web expansion, a first conveyor for carrying said web in a lengthwise direction at an angle to at least a portion of said edge and a second conveyor for carrying the web and abruptly changing the direction of travel of said web at said edge from said lengthwise direction to a second direction and turning the web fibers in said second direction while web fibers are locked at said edge to expand said width with controlled uniformity of fiber orientation, said second conveyor operating at a speed of travel greater than the speed of travel of said first conveyor.

* * * * *

UNITED STATES PATENT AND TRADEMARK OFFICE

CERTIFICATE OF CORRECTION

PATENT NO. : 4,219,911

DATED : September 2, 1980

INVENTOR(S) : John C. Henning

It is certified that error appears in the above-identified patent and that said Letters Patent are hereby corrected as shown below:

Abstract, Line 13 "can be" should be --can also be--

Col. 1, line 12, after the word "more" insert --particularly, for expanding the width while maintaining original--

Col. 5, line 38, "rises" should be --rides--

Col. 6, line 50, "first to" should be --first pair to--

Signed and Sealed this

*Sixteenth* Day of *December 1980*

[SEAL]

*Attest:*

SIDNEY A. DIAMOND

*Attesting Officer*

*Commissioner of Patents and Trademarks*